US010727604B2

(12) United States Patent
Balanis et al.

(10) Patent No.: US 10,727,604 B2
(45) Date of Patent: Jul. 28, 2020

(54) ELECTROMAGNETIC BANDGAP CHECKERBOARD DESIGNS FOR RADAR CROSS SECTION REDUCTION

(71) Applicants: Constantine A. Balanis, Mesa, AZ (US); Wengang Chen, Chandler, AZ (US); Craig R. Birtcher, Scottsdale, AZ (US)

(72) Inventors: Constantine A. Balanis, Mesa, AZ (US); Wengang Chen, Chandler, AZ (US); Craig R. Birtcher, Scottsdale, AZ (US)

(73) Assignee: Arizona Board of Regents on behalf of Arizona State University, Scottsdale, AZ (US)

( * ) Notice: Subject to any disclaimer, the term of this patent is extended or adjusted under 35 U.S.C. 154(b) by 312 days.

(21) Appl. No.: 15/877,792

(22) Filed: Jan. 23, 2018

(65) Prior Publication Data

US 2018/0212331 A1 Jul. 26, 2018

Related U.S. Application Data

(60) Provisional application No. 62/449,357, filed on Jan. 23, 2017.

(51) Int. Cl.
*H01Q 15/14* (2006.01)
*H01Q 15/00* (2006.01)

(52) U.S. Cl.
CPC ..... *H01Q 15/14* (2013.01); *H01Q 15/0086* (2013.01)

(58) Field of Classification Search
CPC ..... H01Q 15/0086; H01Q 15/14
See application file for complete search history.

(56) References Cited

U.S. PATENT DOCUMENTS 5,045,819 A 9/1991 Balanis et al.
8,860,575 B2 10/2014 Allee et al.
(Continued)

FOREIGN PATENT DOCUMENTS

WO 2011022099 A2 2/2011
WO 2011022101 A2 2/2011

OTHER PUBLICATIONS

Chen et al., "Checkerboard EBG Surfaces for Wideband Radar Cross Section Reduction," IEEE Transactions on Antennas and Propagation, vol. 63, No. 6, pp. 2636-2645, Jun. 2015.
(Continued)

*Primary Examiner* — Timothy A Brainard
(74) *Attorney, Agent, or Firm* — Fish & Richardson P.C.

(57) ABSTRACT

An electromagnetic band gap checkerboard surface including a first quadrant, a second quadrant, a third quadrant, and a fourth quadrant. The first and third quadrants each include a multiplicity of first dual-band electromagnetic band gap structures having a first resonant frequency and a second resonant frequency. The second and fourth quadrants each include a multiplicity of second dual-band electromagnetic band gap structure having a third resonant frequency and a fourth resonant frequency. The first quadrant is directly adjacent to the second quadrant and the fourth quadrant; the third quadrant is directly adjacent to the second quadrant and the fourth quadrant; the first quadrant and the third quadrant are diagonally juxtaposed; and the second quadrant and the fourth quadrant are diagonally juxtaposed.

22 Claims, 10 Drawing Sheets
(9 of 10 Drawing Sheet(s) Filed in Color)

(56) References Cited

U.S. PATENT DOCUMENTS

| | | | | |
|---|---|---|---|---|
| 2012/0062433 | A1 | 3/2012 | Balanis et al. | |
| 2018/0212318 | A1 | 7/2018 | Balanis et al. | |
| 2018/0212331 | A1* | 7/2018 | Balanis | H01Q 15/14 |

OTHER PUBLICATIONS

Chen et al., "Dual Wide-Band Checkerboard Surfaces for Radar Cross Section Reduction," IEEE Transactions on Antennas and Propagation, vol. 64, No. 9, Sep. 2016, pp. 4133-4138.
Chen et al., "Scatter Control Using Square and Hexagonal Checkerboard Surfaces," 2015 International Conference on Advanced Technologies for Communications, Oct. 2015, 4 pages.
Iriarte et al., "Broadband radar cross-section reduction using AMC technology," IEEE Trans. Antennas Propag., vol. 61, No. 12, pp. 6136-6143, Dec. 2013.
Iriarte et al., "Dual band RCS reduction using planar technology by combining AMC structures," in Proc. 3rd Eur. Conf. Antennas Propag., Mar. 2009, pp. 3708-3709.
Zhang et al., "AMCs for ultra-thin and broadband RAM design," Electron. Lett., vol. 45, No. 10, pp. 484-485, May 2009.

* cited by examiner

ELECTROMAGNETIC BANDGAP CHECKERBOARD DESIGNS FOR RADAR CROSS SECTION REDUCTION

CROSS-REFERENCE TO RELATED APPLICATION

This application claims the benefit of U.S. Provisional Patent Application 62/449,357 entitled "ELECTROMAGNETIC BANDGAP CHECKERBOARD DESIGNS FOR RADAR CROSS SECTION REDUCTION" filed on Jan. 23, 2017, which is incorporated by reference herein in its entirety.

TECHNICAL FIELD

This invention relates to dual wide-band checkerboard surfaces for radar cross section reduction.

BACKGROUND

Conventional methods to reduce the radar cross section of a structure include changing the shape of the structure to redirect the scattered fields away from the observer and applying radar absorbing material (RAM) to the surface of the structure to minimize the electromagnetic scattering by absorbing some of the power of the incident waves. These designs, however, possess certain drawbacks.

SUMMARY

Electromagnetic Band Gap (EBG) structures for reducing Radar Cross Section (RCS) are described, including EBG structured checkerboard surfaces with −10 dB RCS reduction over dual-band frequency bandwidths.

In a general aspect, an electromagnetic band gap checkerboard includes a first quadrant, a second quadrant, a third quadrant, and a fourth quadrant. The first and third quadrants each include a multiplicity of first dual-band electromagnetic band gap structures having a first resonant frequency and a second resonant frequency. The second and fourth quadrants each include a multiplicity of second dual-band electromagnetic band gap structure having a third resonant frequency and a fourth resonant frequency. The first quadrant is directly adjacent to the second quadrant and the fourth quadrant; the third quadrant is directly adjacent to the second quadrant and the fourth quadrant; the first quadrant and the third quadrant are diagonally juxtaposed; and the second quadrant and the fourth quadrant are diagonally juxtaposed.

Implementations of the general aspect may include one or more of the following features.

In some implementations, each first dual-band electromagnetic band gap structure includes a square loop surrounding a square patch. In some cases, each first dual-band electromagnetic band gap structure is a square and has dimensions in a range between 10 mm×10 mm and 20 mm×20 mm. The outside length of a side of each square loop can be in a range between 10 mm and 18 mm. The inside length of a side of each square loop can be in a range between 6 mm and 16 mm. The square patch may be square and have dimensions in a range between 4 mm and 12 mm. In some cases, the square patch is solid.

In some implementations, each second dual-band electromagnetic band gap structure includes a circular loop surrounding a circular patch. In some cases, each second dual-band electromagnetic band gap structure is square and has dimensions in a range between 10 mm×10 mm and 20 mm×20 mm. The outside diameter of each circular loop can be in a range between 5 mm and 15 mm. The inside diameter of each circular loop can be in a range between 4 mm and 14 mm. The circular patch may be circular and have a diameter in a range between 2 mm and 12 mm. In some cases, the circular patch is solid.

In some implementations, each of the first quadrant and the third quadrant includes $n^2$ first dual-band electromagnetic band gap structure elements and each of the second quadrant and the fourth quadrant includes $n^2$ second dual-band electromagnetic band gap structure elements, where n is an integer greater than or equal to 2.

In some implementations, the first resonant frequency, the second resonant frequency, the third resonant frequency, and the fourth resonant frequency are all different frequencies. The first resonant frequency can be 3.4 GHz. The second resonant frequency may be 9.4 GHz. The third resonant frequency can be 5.9 GHz. The fourth resonant frequency may be 10.9 GHz.

In some implementations, the fields reflected by the first dual-band electromagnetic band gap structures are out-of-phase from fields reflected by the second dual-band electromagnetic band gap structures at two or more frequencies.

In an implementation, the electromagnetic band gap checkerboard surface is square, and a length of each side of the checkerboard surface exceeds 100 mm.

In some implementations, the electromagnetic band gap checkerboard surface demonstrates −10 dB dual radar cross section reduction bandwidths of over 61% and over 24%.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

RCS is a measure of the ability of a radar target to reflect signals in a transceiver direction. RCS reduction is a factor in the design of low-visibility radar targets. EBG structures applied on a surface of a radar target can alter direction of the scattered fields and reduce the RCS of the radar target. Such an alteration in scattering direction is in part due to reflection phase variation with frequency in EBG structures.

One way to broaden the RCS reduction bandwidth of a radar target is to apply two or more EBG structures on surface of the radar target. Another way to broaden RCS reduction bandwidth of the radar target is to use dual-band EBG structures. In some cases, checkerboard of EBG structures ("checkerboard surface") are applied on a radar target surface to achieve −10 dB RCS reduction over wide frequency bandwidths. A checkerboard surface is a ground plane with two or more different periodic patterns on it. At least some of the periodic patterns include EBG structures. The EBG structures can include one or more metals, such as copper.

In some implementations, the EBG structures resonate at two different frequencies. In contrast to narrow band checkerboard surfaces that combine EBG and conductive structures on the same ground plane, the checkerboard surfaces in this disclosure achieve wider bandwidth at least because the reflection phase of each EBG structure can be adjusted, shifted, or both, relative to other EBG structures to improve the bandwidth of the RCS reduction for the entire surface. As such, including two different EBG surfaces (for example, applied on the same ground plane), provides more degrees of freedom to optimize the resonant frequencies of the entire surface to increase RCS reduction bandwidth.

In some implementations, a dielectric substrate is used as an EBG structure substrate (e.g., the same substrate used for a checkerboard surface). In one example, Rogers RT/duroid 5880, with 2.2 dielectric constant and 6.35 mm thickness is used as the substrate.

Figure 1A:
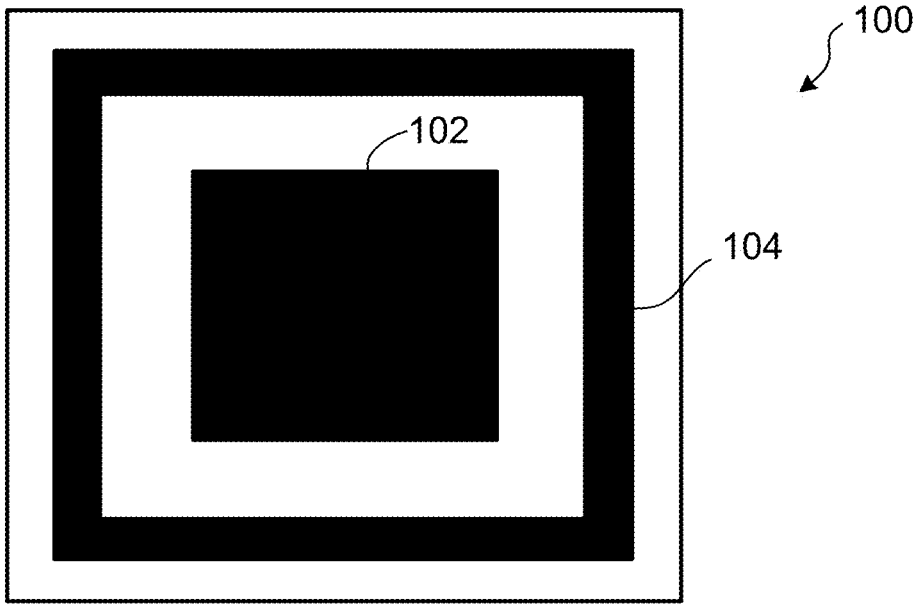
FIGS. 1A-1B depict Electromagnetic Band Gap (EBG) structures.
Figure 1B:
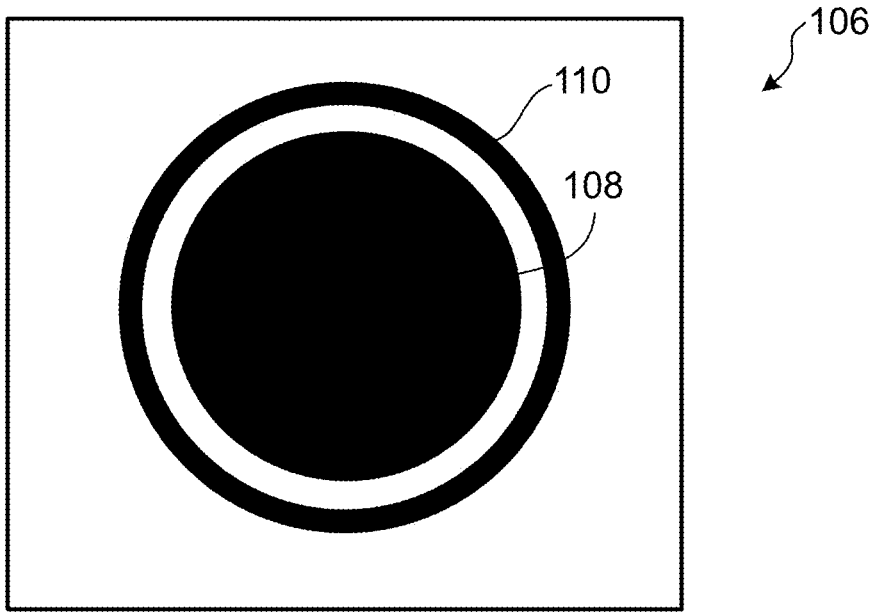

In some implementations, the checkerboard surface includes at least two different designs for the EBG structures. In some implementations, an EBG structure design is repeated on a checkerboard surface and creates an array of EBG structures. In some cases, the dimension of the EBG structure array can be determined based on a targeted scattered direction and operating frequencies. FIGS. 1A and 1B depict two EBG structures that can be included on a checkerboard surface.

FIG. 1A depicts an EBG structure design 100 of a square patch 102 inside a square loop 104. In some examples, the square patch is solid. In some examples, the square patch defines a continuous surface. One design (referred to as "EBG1") has a square loop of 12.0 millimeter (mm)×12.0 mm with the strip width of 1.0 mm and a square patch of 6.3 mm×6.3 mm.

Figure 2A:
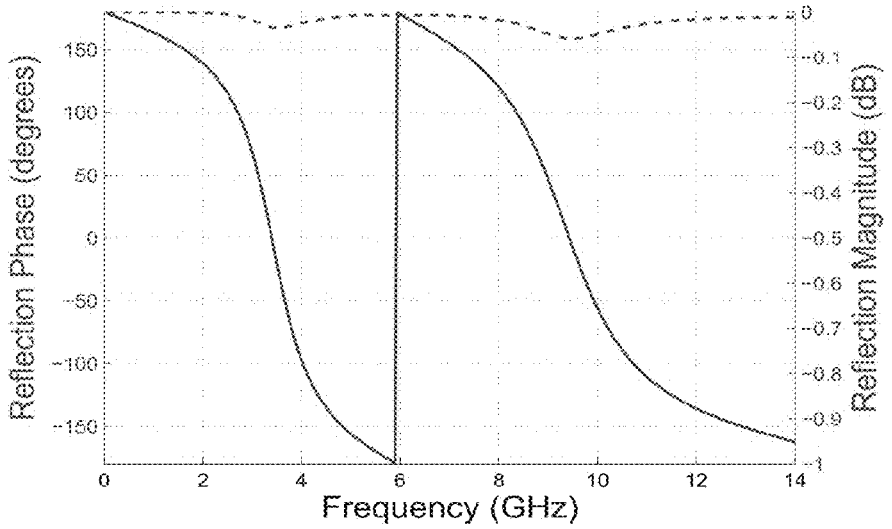
FIGS. 2A-2B are plots showing simulation of the reflection coefficient of two EBG structure designs.

FIG. 2A is a plot showing simulation of the reflection coefficient of an array of EBG1. The array can include more than one EBG1 (e.g., two through five EBG1*s* or more). As illustrated, the reflection coefficient has 0° phase at two frequencies, which exhibit the resonant frequencies of 3.4 and 9.4 GHz, respectively. The phase of the reflection coefficient varies continuously from positive 180° to negative 180° over frequencies.

Figure 2B:
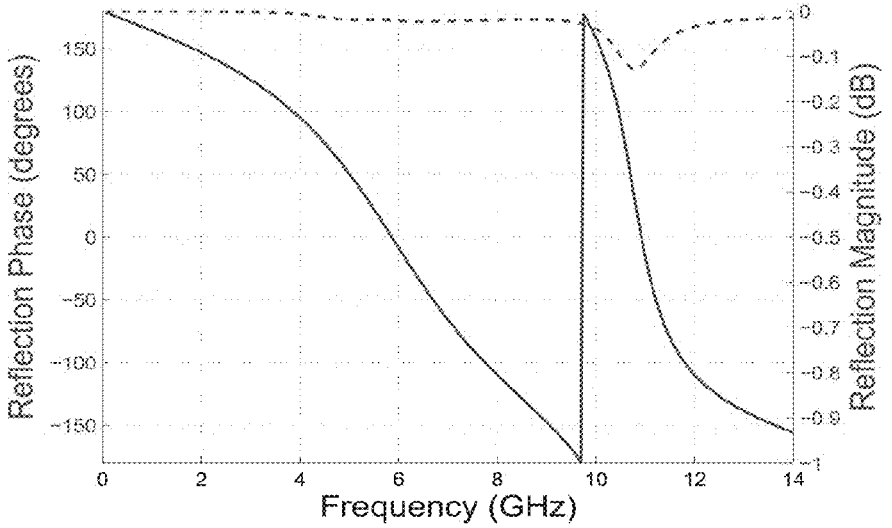

FIG. 1B depicts another EBG structure design 106. The EBG structure design 106 includes a circular patch 108 inside a circular loop 110. In some examples, the circular patch is solid. In some examples, the circular patch defines a continuous surface. One design (referred to as "EBG2") has circular loop with strip width 0.5 mm and an outer radius of 4.5 mm and a patch with a 3.25 mm radius. FIG. 2B is a plot showing simulation of reflection coefficient of an array of EBG2*s*. The array can include more than one EBG2 (e.g., two through five EBG2*s* or more). As illustrated in FIG. 2B, EBG2 has dual resonant frequencies of 5.9 and 10.9 GHz.

In some implementations, the checkerboard surface is divided into two or more sections, and the EGB structures in each section have the same design. In some implementations, the checkerboard is divided into four quadrants (e.g., sections) and the EBG structures in each quadrant have similar (or the same) design. In some cases, each of the first quadrant and the third quadrant includes a multiplicity first dual-band electromagnetic band gap structures (e.g., EBG1) having a first resonant frequency and a second resonant frequency (e.g., 3.4 and 9.4 GHz). As used in the present disclosure, "multiplicity" generally refers to two or more. In some cases, each of the second quadrant and the fourth quadrant includes a multiplicity second dual-band electromagnetic band gap structure (e.g., EBG2) having a third resonant frequency and a fourth resonant frequency (e.g., 5.9 and 10.9 GHZ). The first quadrant may be directly adjacent to the second quadrant and the fourth quadrant; the third quadrant may be directly adjacent to the second quadrant and the fourth quadrant; the first quadrant and the third quadrant may be diagonally juxtaposed; and the second quadrant and the fourth quadrant may be diagonally juxtaposed.

In some implementations, the checkerboard surface includes a first and a second dual-band structure designs (e.g., EBG1 and EBG2). In some cases, each first dual-band EBG structure (for example, on a checkerboard with four quadrants), includes a square loop surrounding a square patch. In some examples, each first dual-band EBG structure is square and has dimensions in a range between 10 mm×10 mm and 20 mm×20 mm. In some examples, an outside length of a side of each square loop is in a range between 10 mm and 18 mm. In some examples, an inside length of a side of each square loop is in a range between 6 mm and 16 mm. In some examples, the square patch is square and has dimensions in a range between 4 mm and 12 mm. In some examples, the square patch is solid.

In some cases, each second dual-band electromagnetic band gap structure include a circular loop surrounding a circular patch. In some examples, each second dual-band EBG structure is square and has dimensions in a range between 10 mm×10 mm and 20 mm×20 mm. In some examples, an outside diameter of each circular loop is in a range between 5 mm and 15 mm. In some examples, an inside diameter of each circular loop is in a range between 4 mm and 14 mm. In some examples, the circular patch is circular and has a diameter in a range between 2 mm and 12 mm. In some examples, the circular patch is solid.

In some implementations, the first quadrant and the third quadrant (of a four-quadrant checkerboard surface) each includes $n^2$ first dual-band electromagnetic band gap structure elements and the second quadrant and the fourth quadrant (of the four-quadrant checkerboard surface) each includes $n^2$ second dual-band electromagnetic band gap structure elements, where n is an integer greater than or equal to 2.

In some implementations, the first resonant frequency, the second resonant frequency, the third resonant frequency, and the fourth resonant frequency (of a checkerboard surface with four quadrants) are all different frequencies. In some examples, the first resonant frequency is 3.4 GHz. In some examples, the second resonant frequency is 9.4 GHz. In some examples, the third resonant frequency is 5.9 GHz. In some examples, the fourth resonant frequency is 10.9 GHz.

In some implementations with two or more EBG structure designs, at certain frequencies the field reflected (or scattered) under the normal incidence from one EBG structure design is out-of-phase from the fields scattered under the normal incidence from other EBG structure designs. At these certain frequencies, the scattered fields can be canceled along the normal direction, where the normal direction is direction of the maximum scattered field by a Perfect Electric Conductor (PEC). A PEC material is an idealized material exhibiting infinite electrical conductivity.

Figure 3:
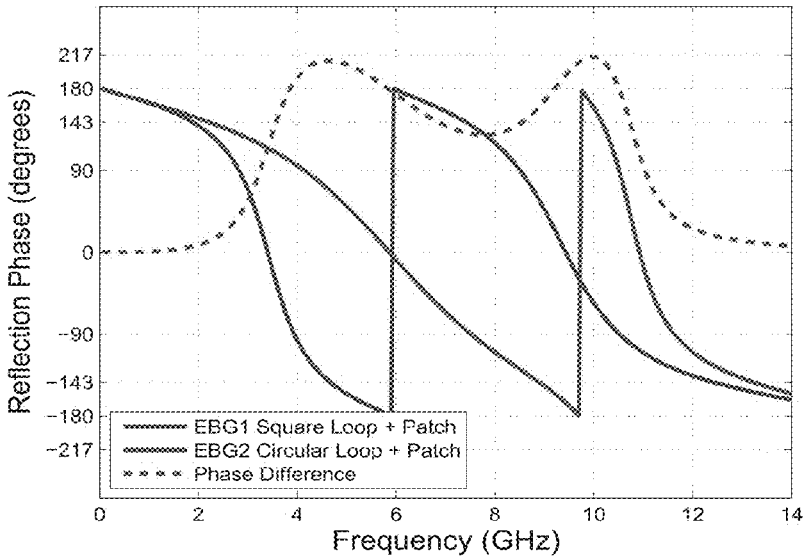
FIG. 3 is a plot showing reflection coefficient and phase differences for two EBG structure designs.

In some examples, the reflected fields from two EBG structures can be out of phase in one or more frequencies. For example, FIG. 3 is a plot showing reflection coefficients of EBG1 and EBG2 and the phase difference between the reflection coefficients of EBG1 and EBG2 on a checkerboard. As illustrated, the fields reflected from EBG1 are out-of-phase from the fields reflected from EBG2 at two frequencies of 4.6 and 9.9 GHz. Accordingly, a checkerboard surface that includes EBG1 and EBG2 cancels the scattered fields along the normal direction at two frequencies of 4.6 and 9.9 GHz. The checkerboard can have four quadrants. In some cases, the checkerboard has at least four EBG1 and EBG2.

In some implementations with first and second dual-band EBG structures, fields reflected by the first dual-band EBG structures are out-of-phase from fields reflected by the second dual-band EBG structures at two or more frequencies. In some implementations, the checkerboard surface has four quadrants and is designed as square surface and the dual-band EBG structures on the four quadrants of the checkerboard surface cancel the scattered fields along the principal planes (e.g., along the sides of the checkerboard) and redirect the scattered fields toward the four quadrants. In some examples, the checkerboard surface is square, and length of each side exceeds 100 mm.

Figure 4:
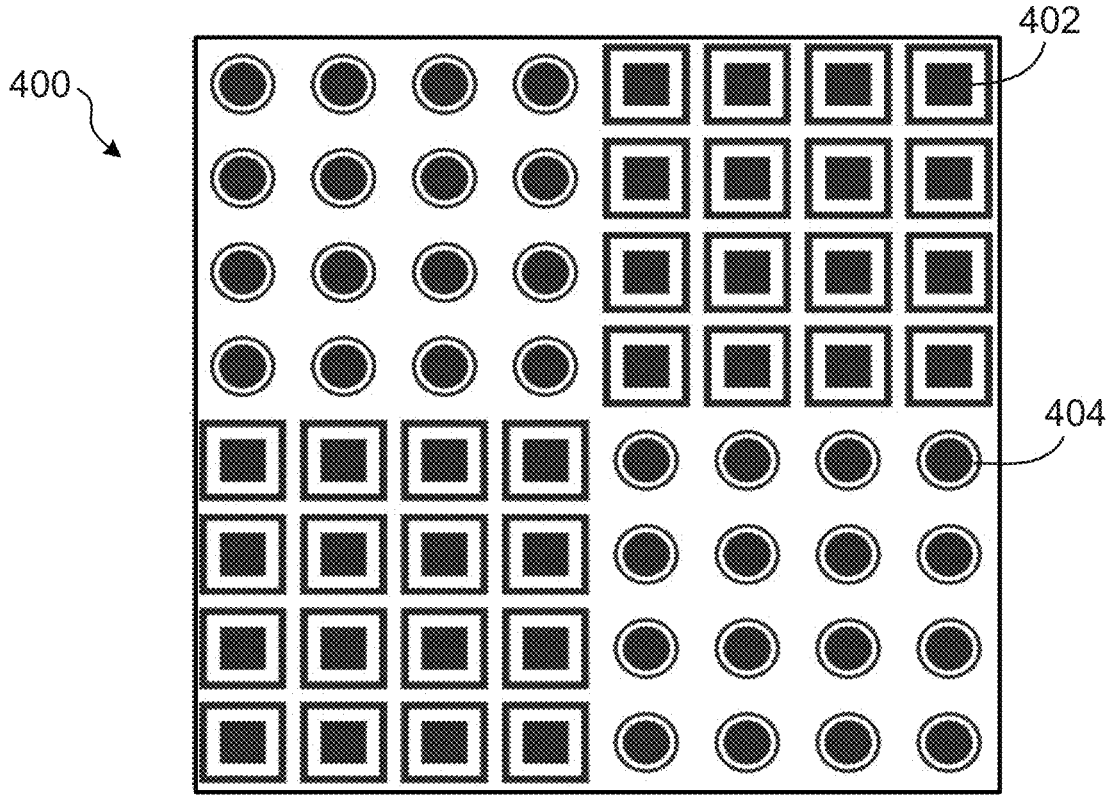
FIG. 4 depicts a checkerboard surface with more than one EBG structure designs.

FIG. 4 depicts a checkerboard surface 400 with more than one EBG structure design. The checkerboard surface 400 has four quadrants, and includes two dual-band EBG structures (EBG structures 402 and 404). Accordingly, 400 is a four-quadrant dual-frequency band checkerboard surface. In some examples, the EBG structure 402 has the EBG1 design and the EBG structure 404 has the EBG2 design.

The −10 dB RCS reduction of the checkerboard surface 400 can be approximated by:

$$RCS\ \text{Reduction} = 10\log\left[\frac{A_1 e^{jP_1} + A_2 e^{jP_2}}{2}\right]^2 \quad (1)$$

where $A_1$ and $A_2$ are the reflection magnitudes of the two EBG structures 402 and 404, and $P_1$ and $P_2$ are the reflection phases of the two EBG structures 402 and 404, respectively; j is an imaginary number and $j^2=-1$. Equation (1) serves as a guideline for predicting the −10 dB RCS reduction bandwidth of a checkerboard surface. In some implementations, the checkerboard surface demonstrates −10 dB dual radar cross section reduction bandwidths of over 61% and over 24%.

Figure 5:
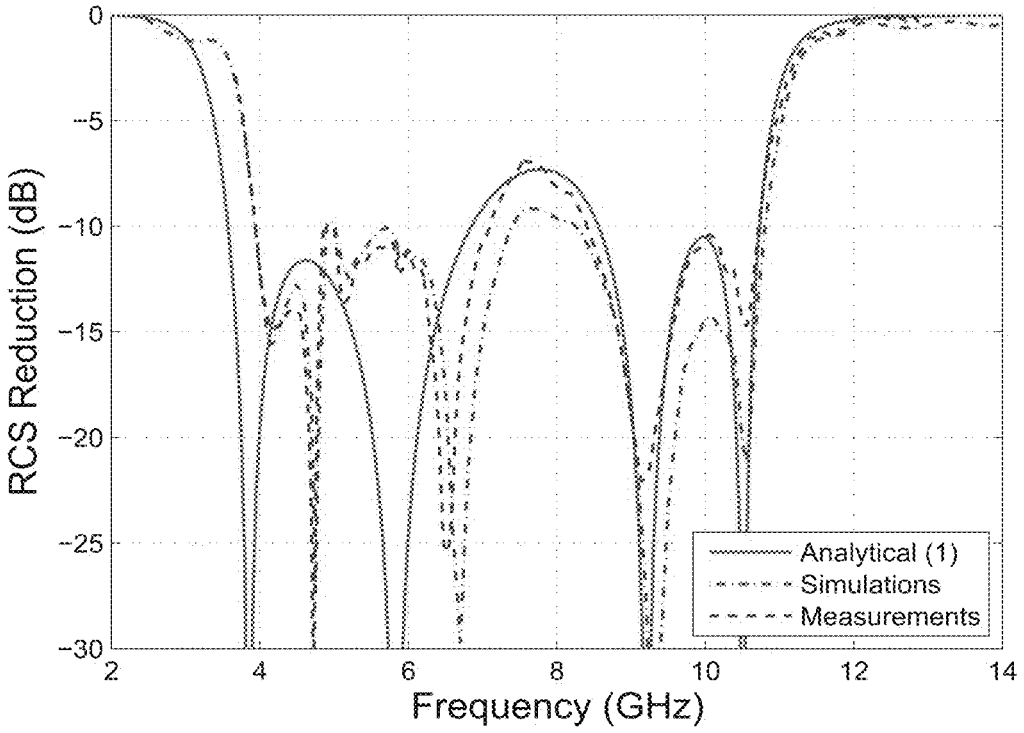
FIG. 5 is a plot showing predicted RCS reduction for a checkerboard surface designed.

FIG. 5 is a plot showing predicted RCS reduction of an example implementation designed according to the checkerboard surface 400 with EBG1 and EBG2 structures, using Equation (1). As illustrated, the predicted −10 dB RCS reduction bandwidth along the normal direction for two frequency bands of 3.58-6.85 GHz and 8.56-10.73 GHz, are 63% and 23% of the frequency bands, respectively. These two frequency bands correspond to 180±37° phase difference between EBG structures 402 and 404, as shown in FIG. 4.

EXAMPLES

Figure 6:
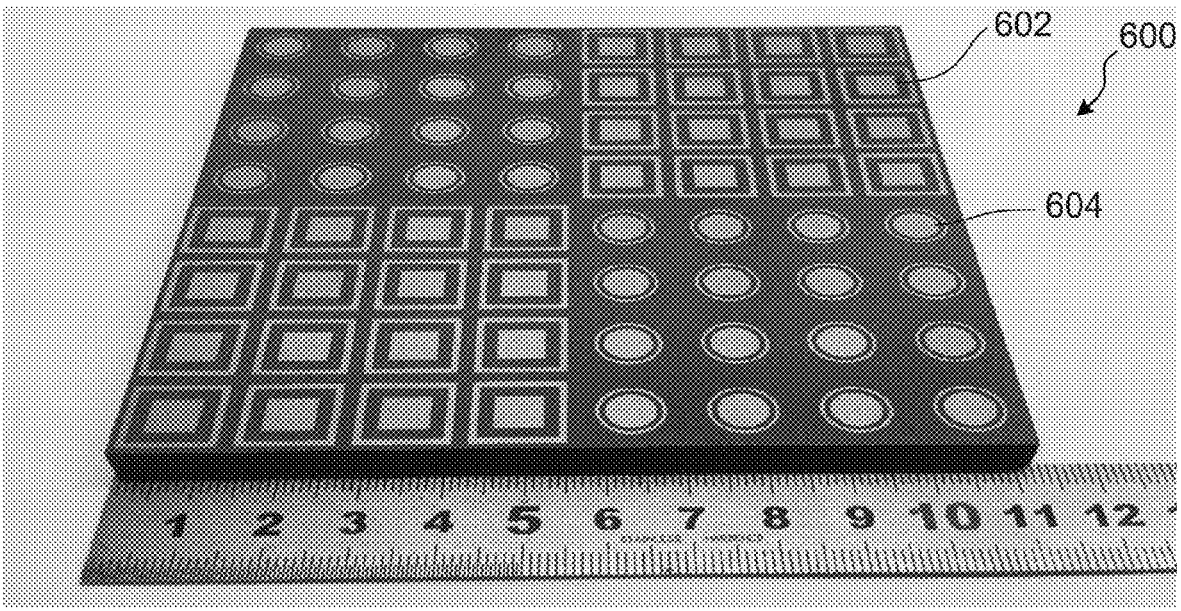
FIG. 6 depicts a checkerboard surface.

A dual-band checkerboard surface 600, whose pattern is shown in FIG. 4, was designed, simulated, and fabricated as depicted in FIG. 6. The checkerboard surface 600 includes EBG structures (for example, 602 and 604 associated with EBG structures 402 and 404, respectively) designed according to EBG1 and EBG2 designs explained previously. The overall side dimensions of the checkerboard surface 600 were 112 mm×112 mm. The checkerboard surface ground plane was simulated and measured, in terms of RCS reduction, over the frequencies from 2.0 to 14.0 GHz. The −10 dB RCS reduction, in the frequency bands of 3.94-7.40 GHz and 8.41-10.72 GHz, as simulated were of 61% and 24% bandwidths, respectively, and as measured were 57% and 24% bandwidths, respectively. Comparison indicates agreement between the predicted, the simulated, and the measured RCS reduction bandwidth.

The following provides bistatic and monostatic RCS simulation and measurement data of the checkerboard surface 600.

A. Bistatic RCS

Figure 7:
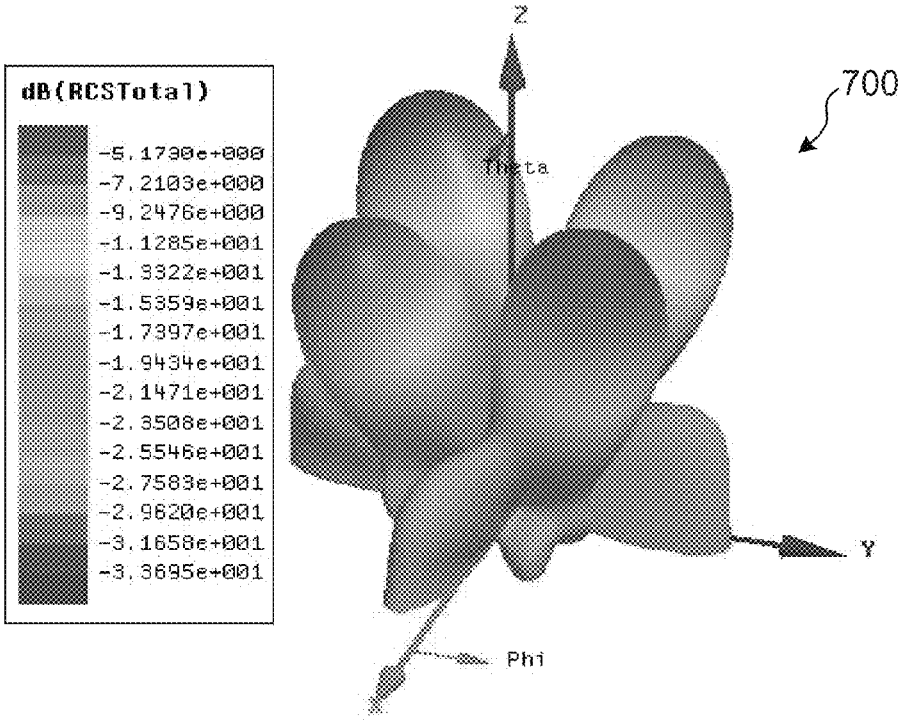
FIG. 7 depicts a three-dimensional (3-D) bistatic RCS pattern at 6.5 GHz, for the checkerboard surface depicted in FIG. 6.

FIG. 7 depicts a 3-D bistatic RCS pattern 700. The bistatic RCS pattern 700 illustrates a scattering pattern of the checkerboard surface 600 at 6.5 GHz. As illustrated, the pattern 700 exhibits four main reflected lobes at Φ=45°, 135°, 225°, and 315°.

Figure 8:
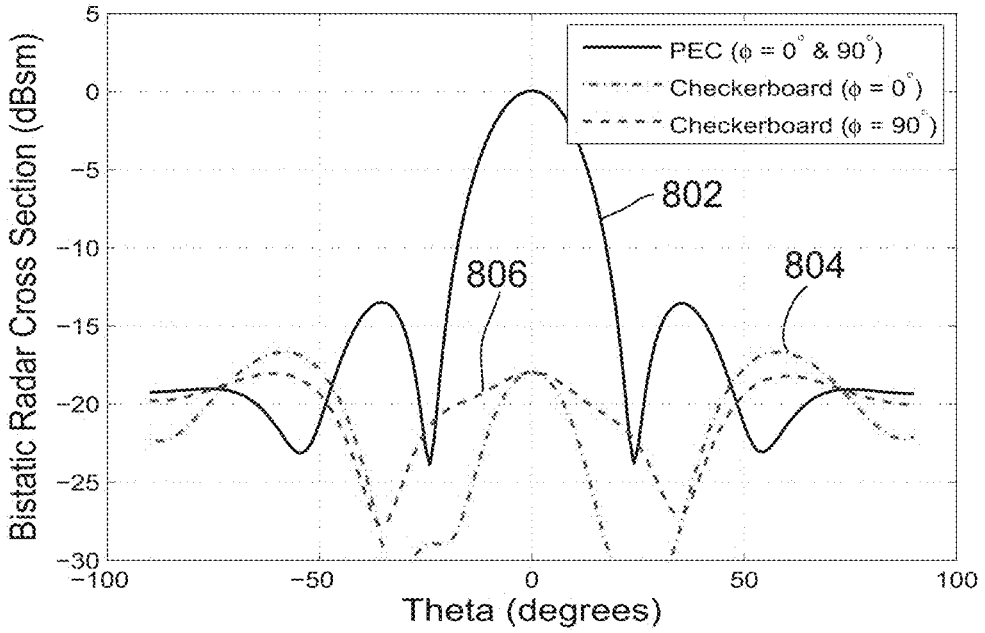
FIG. 8 is a plot showing a two-dimensional (2-D) representation of FIG. 7 along xz and zy planes.

FIG. 8 is a plot showing 2-D bistatic RCS patterns of scattering fields of the checkerboard surface 600 at 6.5 GHz along xz and zy planes. FIG. 8 is a two-dimensional (2-D) representation of FIG. 7 along xz and yz plane. The pattern 802 illustrates the RCS pattern for a PCE surface along both xz (Φ=0°) and yz (Φ=90°) planes. Patterns 804 and 806 illustrate the RCS patterns of the checkerboard 600 along plane xz, and plane yz, respectively. As illustrated, in principal planes xz and yz, the maximum RCS of the checkerboard surface 600 was lower than the maximum RCS of the PEC surface, by 16.8 dB.

Figure 9:
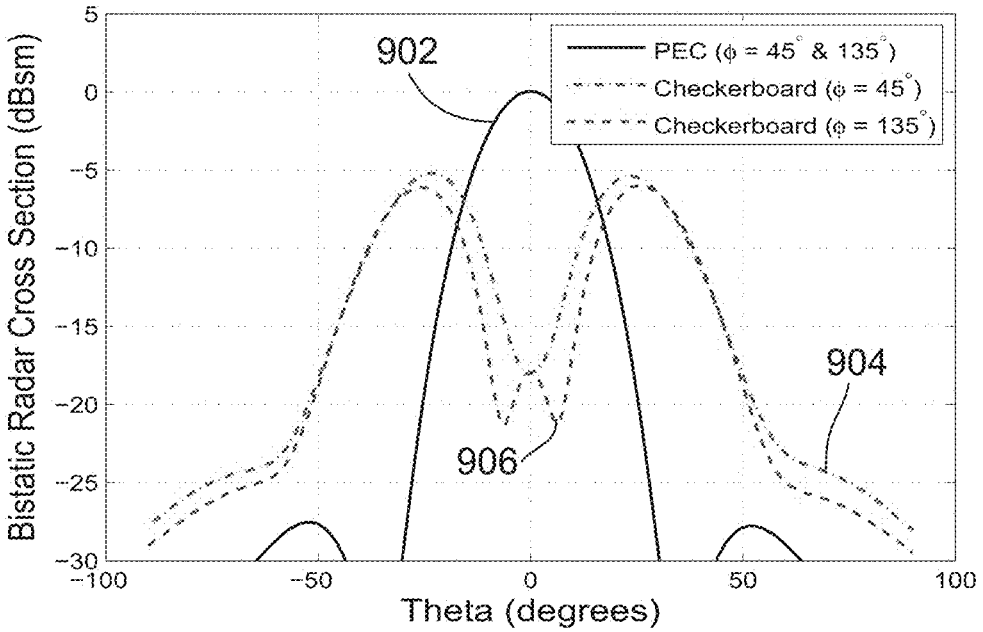
FIG. 9 is a plot showing 2-D representation of FIG. 7 along Φ=45° and Φ=135° plane.

FIG. 9 is a plot showing 2-D bistatic RCS patterns of scattering fields of the checkerboard surface 600 at 6.5 GHz along Φ=45° and Φ=135° planes. FIG. 9, is a two-dimensional representation of FIG. 7 along diagonal planes Φ=45° and Φ=135°. The pattern 902 illustrates the RCS pattern for a PCE surface along both Φ=45° and Φ=135° planes. Patterns 904 and 906 illustrate the RCS patterns of the checkerboard 600 (the four lobes in FIG. 7), along plane Φ=45°, and plane Φ=135°, respectively. As simulated, the maximum RCS of the checkerboard surface 600 in the diagonal planes (Φ=45° and 135°) were at θ=24°. As illustrated, the maximum RCS of patterns 904 and 906 were lower than the maximum RCS of the PEC surface by 5.2 dB. This lower RCS was due to the redirection of the reflected fields in four directions along the diagonal planes, instead of a single lobe in the normal direction for the PEC surface.

Figure 10:
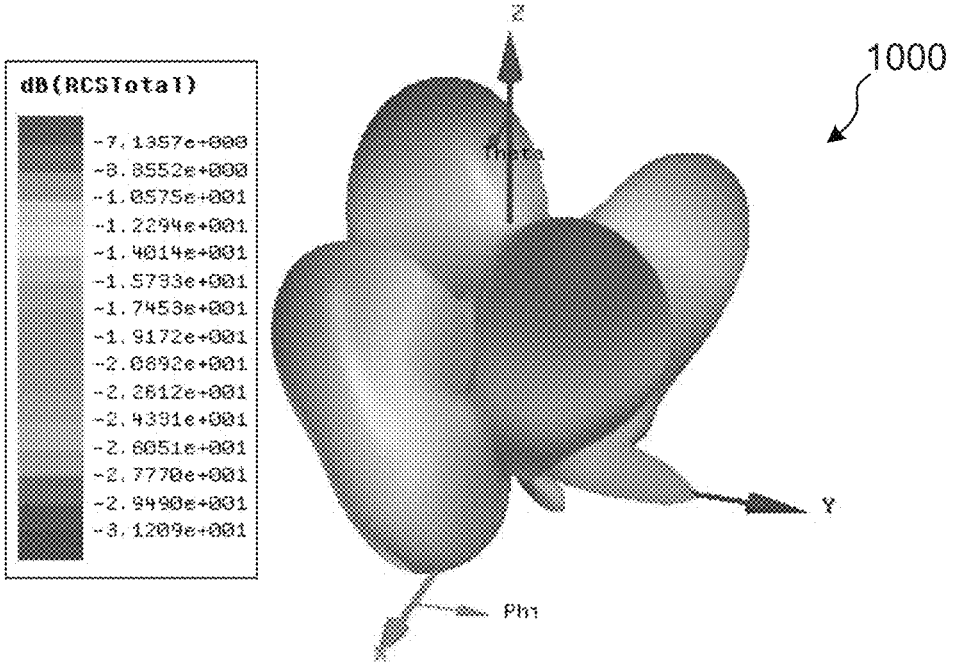
FIG. 10 depicts a 3-D bistatic RCS pattern at 5.2 GHz, for the checkerboard surface depicted in FIG. 6.

FIG. 10 depicts a 3-D bistatic RCS pattern 1000. The bistatic RCS pattern 1000 illustrates scattering pattern of the checkerboard surface 600 with at 5.2 GHz. As illustrated, the pattern 1000 exhibits four main reflected lobes.

Figure 11:
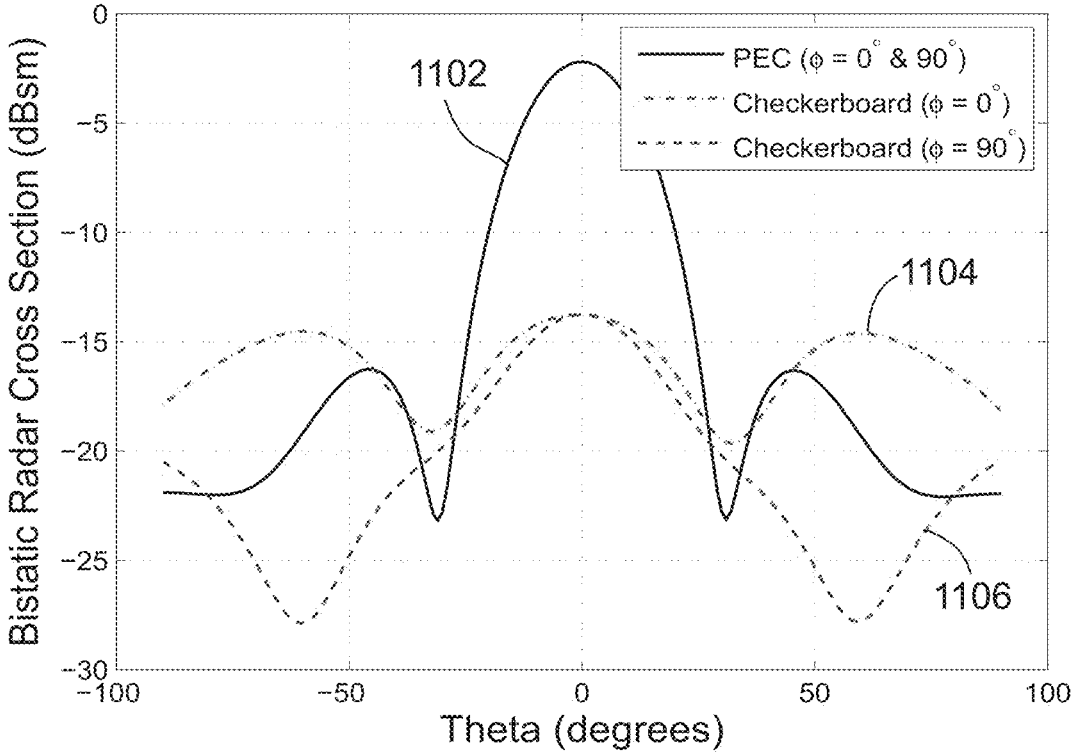
FIG. 11 is plot showing a 2-D representation of FIG. 10 along xz and zy planes.

FIG. 11 is a plot showing 2-D bistatic RCS patterns of scattering fields of the checkerboard surface 600 at 5.2 GHz along xz and zy planes. FIG. 11, is a two dimensional representation of FIG. 10, along the xz and yz plane. The pattern 1102 illustrates the RCS pattern for a PCE surface along both xz (Φ=0°) and yz (Φ=90°) planes. Patterns 1104 and 1106 illustrate the RCS patterns of the checkerboard 600 along plane xz, and plane yz, respectively. As illustrated, in principal planes xz and yz, the maximum RCS of the checkerboard surface 600 was lower than the maximum RCS of the PEC surface by 11.5 dB.

Figure 12:
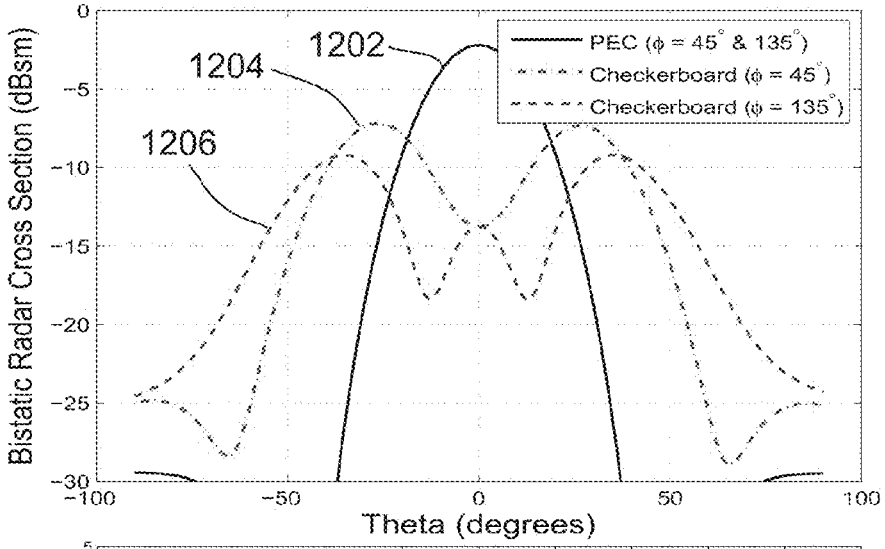
FIG. 12 is a plot showing 2-D representation of FIG. 10 along Φ=45° and Φ=135° plane.

FIG. 12 is a plot showing 2-D bistatic RCS patterns of scattering fields of the checkerboard surface 600 at 5.2 GHz along Φ=45° and Φ=135° planes. FIG. 12, is a two dimensional representation of FIG. 10 along diagonal planes Φ=45° and Φ=135°. The pattern 1202 illustrates the RCS pattern of a PCE surface along both Φ=45° and Φ=135° planes. Patterns 1204 and 1206 illustrate the RCS patterns of the checkerboard 600 (the four lobes in FIG. 10) along plane Φ=45°, and plane Φ=135°, respectively. The maxima of the RCS in the diagonal planes (Φ=45° and Φ135°, as simulated, were at θ=27° and 35°. As illustrated, the maximum RCS of patterns 1204 and 1206 were lower than the maximum RCS of the PEC surface by 5.1 dB and 7.1 dB, respectively. In some simulations, the four main lobes of RCS may have different amplitudes. This can be due to asymmetrical physical design geometry or diffractions along the edges of the checkerboard surface.

B. Monostatic RCS

Reflection coefficient of an EBG structure varies with polarization and incident angle. Performance under oblique incidence for Transverse Electric (TEz) and Transverse Magnetic (TMz) polarizations is described. The 2-D monostatic RCS patterns of the checkerboard EBG surface of FIG. 6 at two different frequencies, 6.5 and 5.2 GHz, were simulated and measured for both TEz and TMz polarized fields. These RCS patterns were also compared with the monostatic RCS for the corresponding PEC surfaces. Those RCS patterns are illustrated and discussed in the following.

Figure 13:
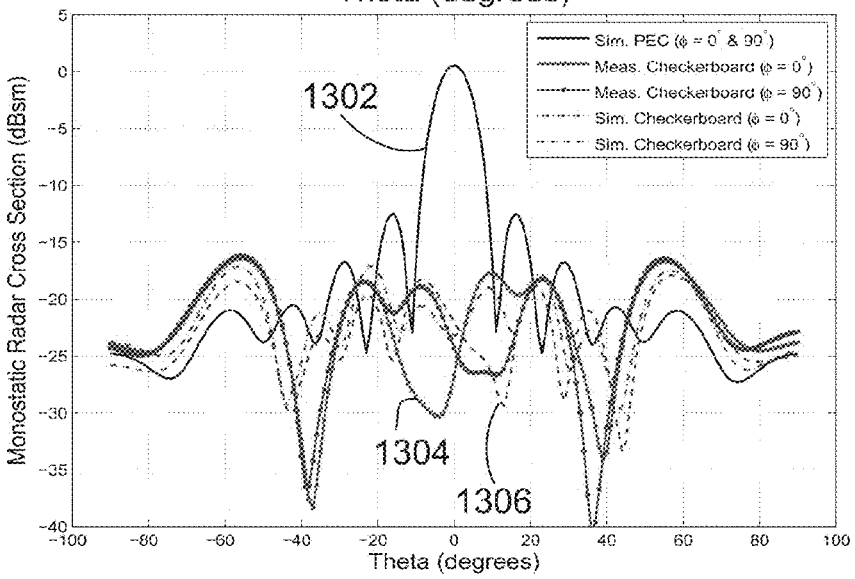
FIG. 13 is a plot showing TEz polarization 2-D monostatic RCS patterns at 6.5 GHz in the xz and yz planes for the checkerboard surface depicted in FIG. 6.

FIG. 13 is a plot showing TEz polarization 2-D monostatic RCS patterns at 6.5 GHz in the xz and yz planes. The pattern 1302 illustrates TEz polarization RCS pattern for a PCE surface along both xz (Φ=0°) and yz (Φ=90°) planes. Patterns 1304 and 1306 illustrate TEz polarization RCS patterns of the checkerboard 600 along plane xz, and plane yz, respectively. As illustrated, in normal direction, the TEz polarization of the checkerboard surface 600 was lower than the RCS of the PEC surface by 22 dB. The maxima TEz polarization of the checkerboard surface 600 was on the side lobes, and was lower than the maximum of the corresponding PEC surface by 16.9 dB.

Figure 14:
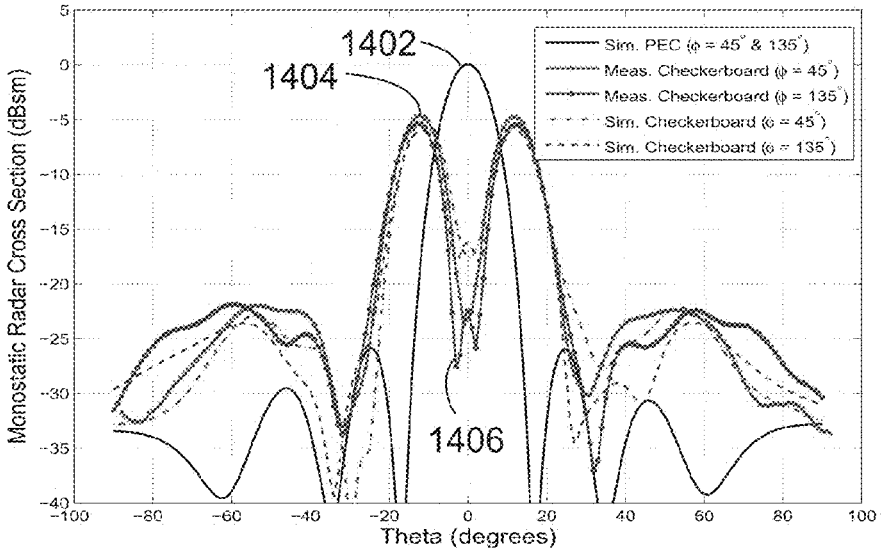
FIG. 14 is a plot showing TEz polarization 2-D monostatic RCS patterns at 6.5 GHz in Φ=45° and Φ=135° planes for the checkerboard surface depicted in FIG. 6.

FIG. 14 is a plot showing TEz polarization 2-D monostatic RCS patterns at 6.5 GHz in Φ=45° and Φ=135° planes. The pattern 1402 illustrates TEz polarization RCS pattern for a PCE surface along both Φ=45° and Φ=135° planes. Patterns 1404 and 1406 illustrate TEz polarization RCS patterns of the checkerboard 600 along Φ=45° and Φ=135° planes, respectively. Patterns 1404 and 1406 show that the maxima of the monostatic RCS for checkerboard surface 600 was at four main scattered beams are directed at Φ=12°, which can be due to the wave redirection by the checkerboard surface. The maxima TEz polarization of the surface checkerboard 600 were at the four beams and were lower than to the maximum of the related PEC surface by 5.8 dB.

Figure 15:
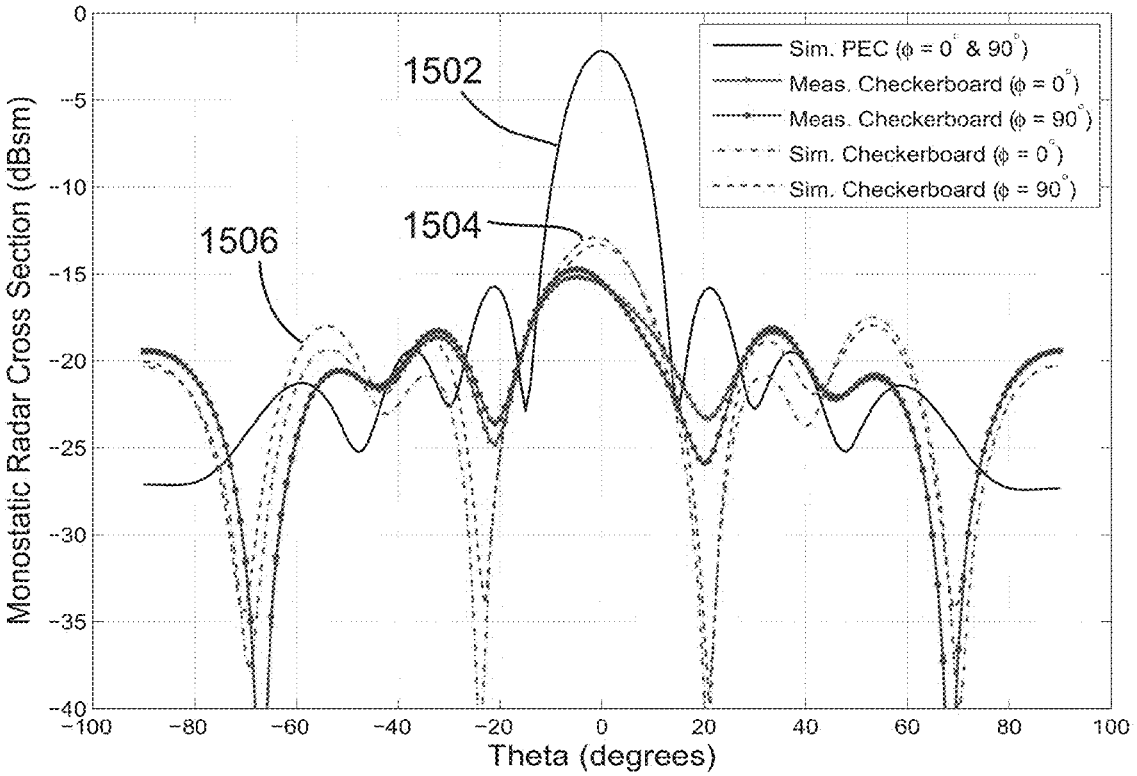
FIG. 15 is a plot showing TEz polarization 2-D monostatic RCS patterns at 5.2 GHz in xz and yz planes for the checkerboard surface depicted in FIG. 6.

FIG. 15 is a plot showing TEz polarization 2-D monostatic RCS patterns at 5.2 GHz in the xz and yz planes. The pattern 1502 illustrates TEz polarization RCS pattern for a PCE surface along both xz (Φ=0°) and yz (Φ=90°) planes. Patterns 1504 and 1506 illustrate TEz polarization RCS patterns of the checkerboard 600 along plane xz, and plane yz, respectively. As illustrated, in normal direction, the TEz polarization of the checkerboard surface 600 was lower than the RCS of the PEC surface by 10.9 dB.

Figure 16:
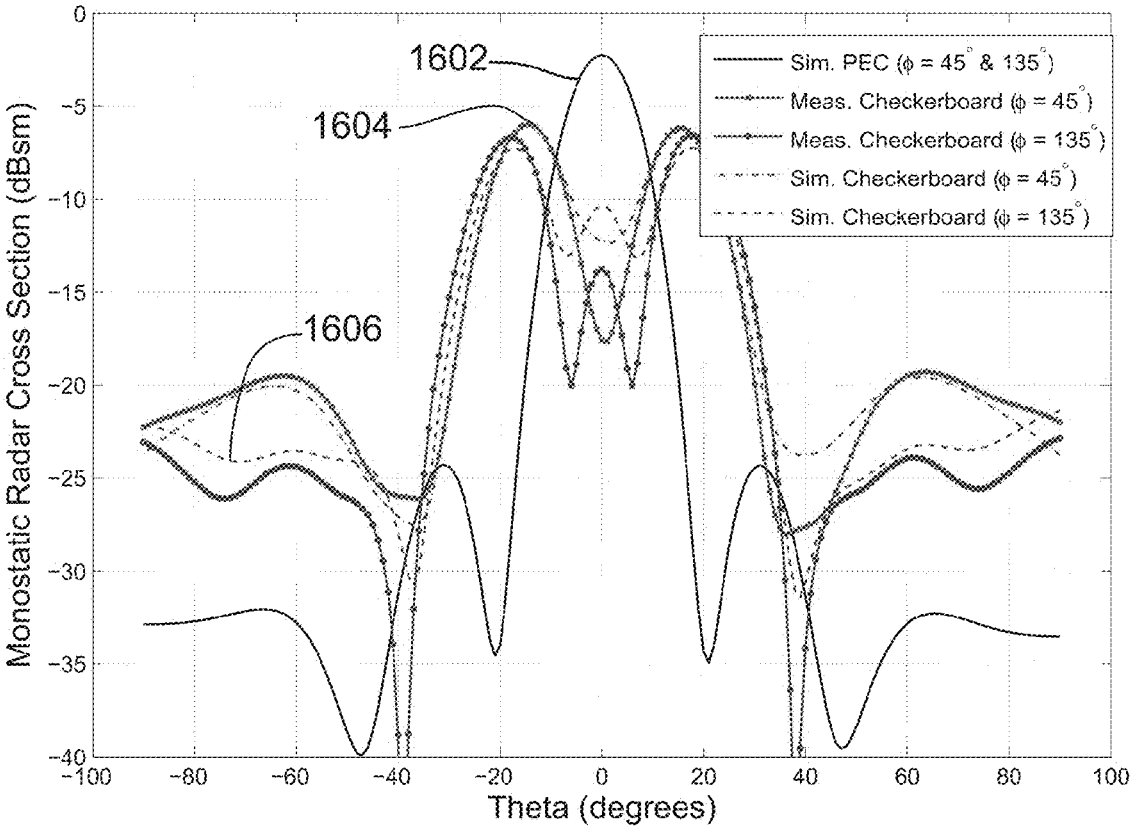
FIG. 16 is a plot showing TEz polarization 2-D monostatic RCS patterns at 5.2 GHz in Φ=45° and Φ=135° planes for the checkerboard surface depicted in FIG. 6.

FIG. 16 is a plot showing TEz polarization 2-D monostatic RCS patterns at 5.2 GHz in Φ=45° and Φ=135° planes. The pattern 1602 illustrates TEz polarization RCS pattern for a PCE surface along both Φ=45° and Φ=135° planes. Patterns 1604 and 1606 illustrate TEz polarization RCS patterns of the checkerboard 600 along Φ=45° and Φ=135° planes, respectively. Patterns 1604 and 1606 show that the maxima of the monostatic RCS for checkerboard surface 600 were at four main scattered beams are directed at Φ=18°. The maxima TEz polarization of the surface checkerboard 600 was lower than to the maximum of the related PEC surface by 5.3 dB.

Figure 17:
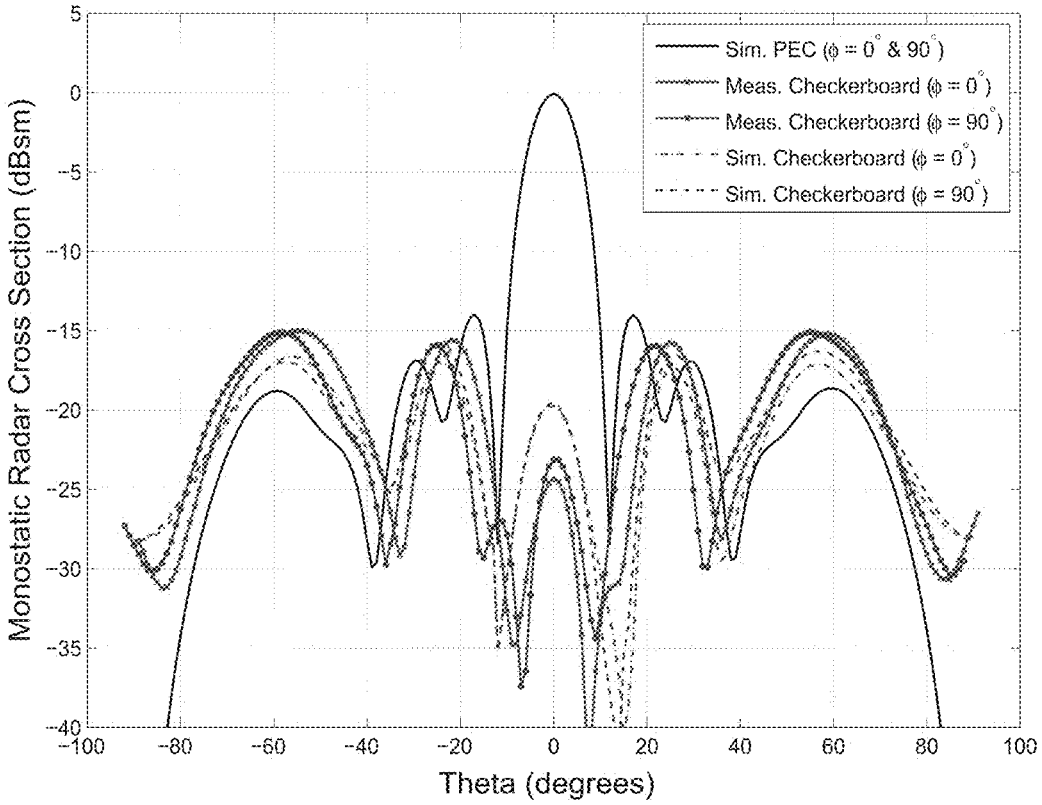
FIG. 17 is a plot showing TMz polarization 2-D monostatic RCS patterns at 6.5 GHz in xz and yz planes for the checkerboard surface depicted in FIG. 6.
Figure 18:
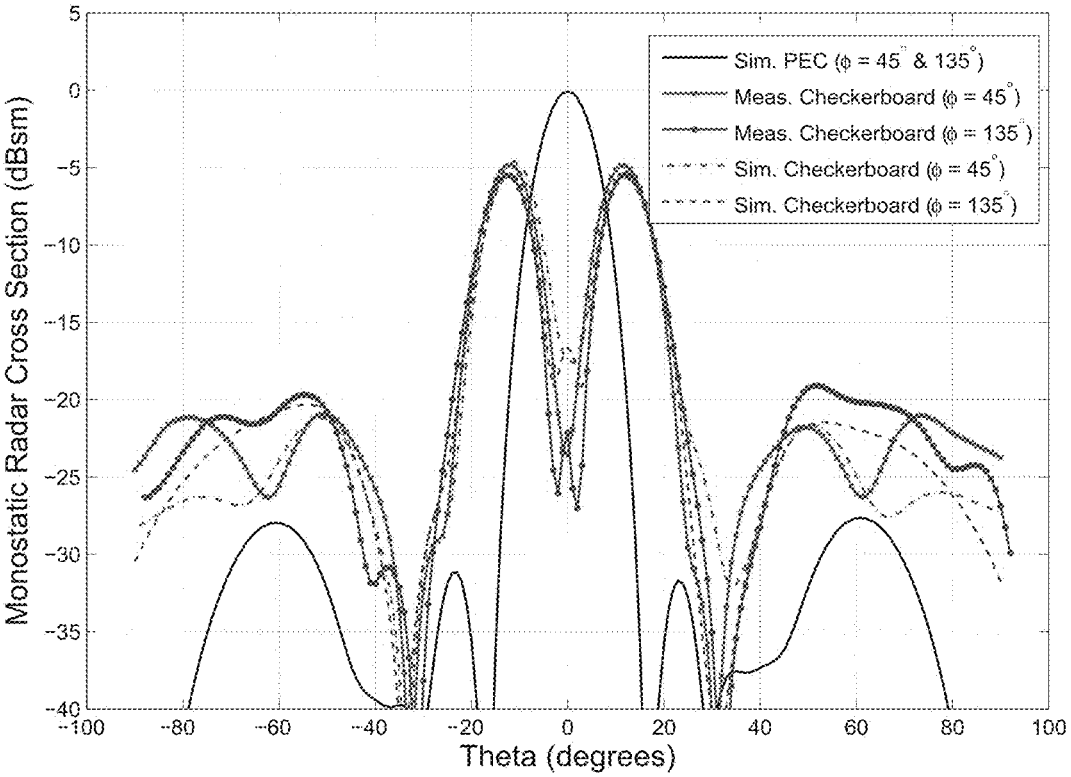
FIG. 18 is a plot showing TMz polarization 2-D monostatic RCS patterns at 6.5 GHz in Φ=45° and Φ=135° planes for the checkerboard surface depicted in FIG.6.

TMz polarization 2-D monostatic RCS patterns at 6.5 GHz are shown in FIGS. 17 and 18. FIG. 17 illustrates the patterns in the xz and yz planes, and FIG. 18 illustrates the patterns in Φ=45° and Φ=135° planes. The patterns illustrate that the maxima of the scattered fields from the checkerboard surface 600 were reduced by 14.2 dB compared to the maximum of the corresponding PEC surface along the xz and yz planes (FIG. 17), and the four main reflected lobes were directed at θ=12° in the Φ=45° and 135° planes (FIG.18). In addition, the maxima for the checkerboard surface 600 were reduced by 5.0 dB compared to the maximum of the related PEC surface (FIG. 18).

Figure 19:
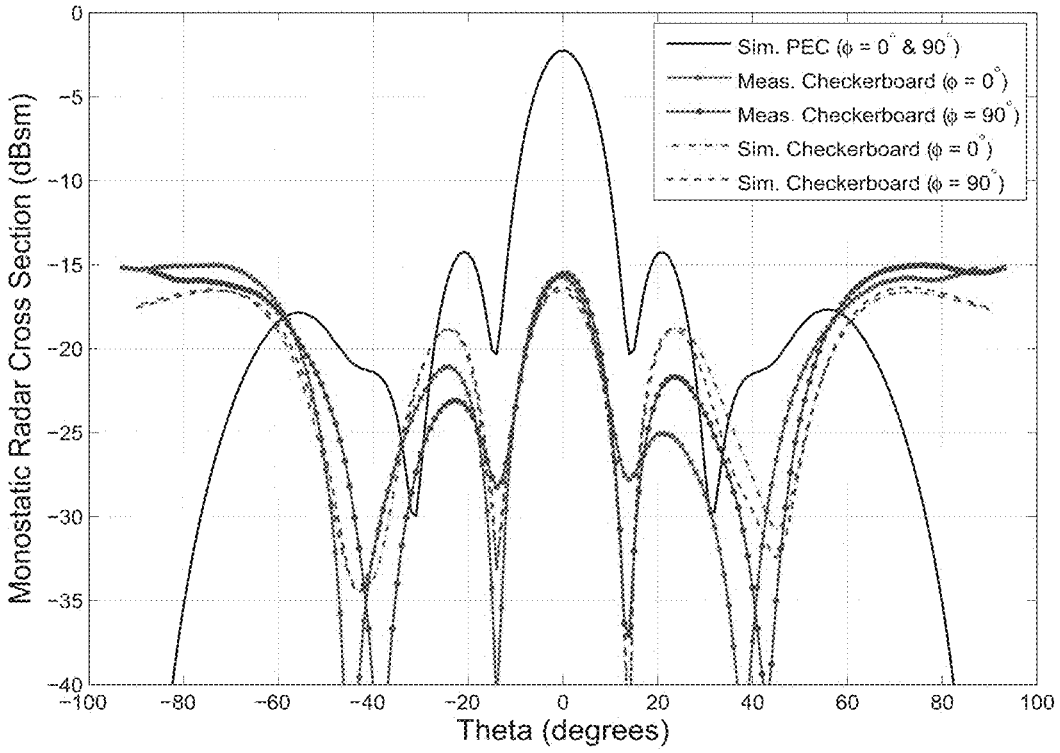
FIG. 19 is a plot showing TMz polarization 2-D monostatic RCS patterns at 5.2 GHz in xz and yz planes for the checkerboard surface depicted in FIG. 6.
Figure 20:
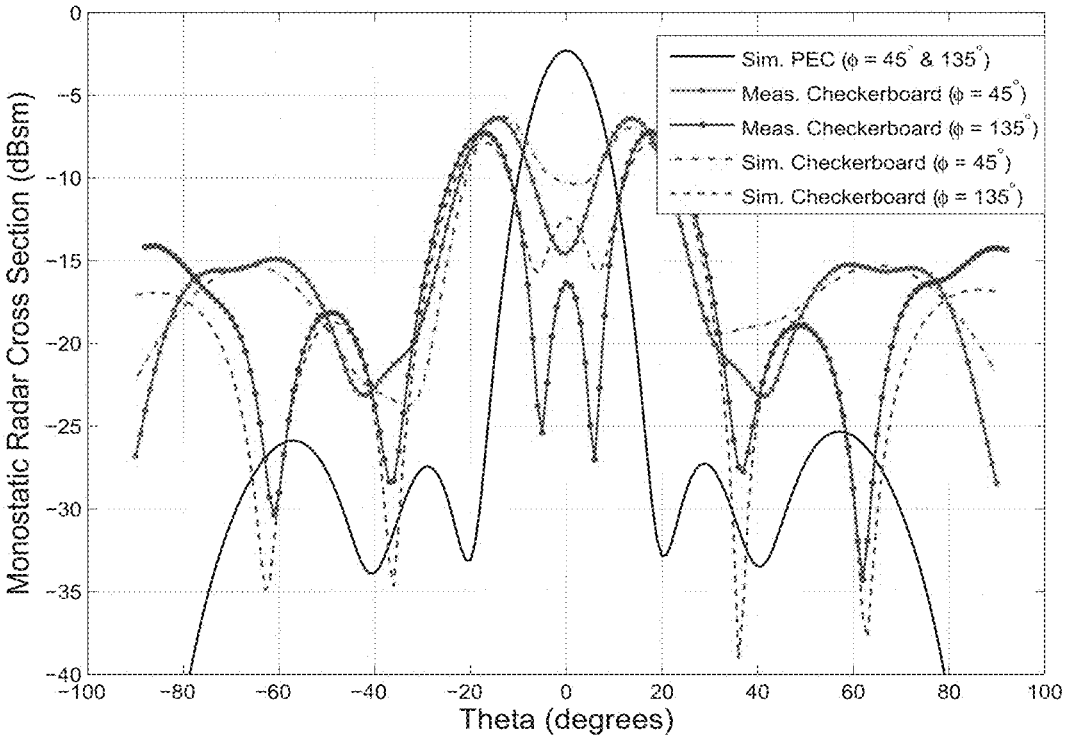
FIG. 20 is a plot showing TMz polarization 2-D monostatic RCS patterns at 5.2 GHz in Φ=45° and Φ=135° planes for the checkerboard surface depicted in FIG. 6.

TMz polarization 2-D monostatic RCS patterns at 5.2 GHz are shown in FIGS. 19 and 20. FIG. 19 illustrates the patterns in the xz and yz planes, and FIG. 20 illustrates the patterns in Φ=45° and Φ=135° planes. As illustrated, TMz polarization RCS maximum was reduced by 13.0 dB in the checkerboard surface 600 compared to the maximum of the related PEC surface along the xz and yz planes (FIG. 19). The four main scattered lobes were directed at θ=18° along the Φ=45° and 135° planes, and the RCS maxima were reduced by 5.1 dB in the checkerboard surface 600 compared to the maximum of the corresponding PEC surface (FIG. 20).

In summary, a dual-band checkerboard surface that includes two different dual-band EBG structures were designed, simulated, fabricated, and measured. The checkerboard surface obtained −10 dB dual RCS reduction bandwidth of over 61% and over 24%. As illustrated in the example measurement and simulations, the RCS along the xz and yz principal planes was reduced at least because the maxima of the scattered fields by the checkerboard EBG surface are redirected toward four directions along the diagonal Φ=45° and 135° planes. The maxima of the bistatic RCS patterns were reduced by 5.2 and 5.1 dB, from those of the corresponding PEC surface, at 6.5 and 5.2 GHz, respectively. Also, for a checkerboard surface with EBG structure according to the example design 600, the measured monostatic scattering patterns at the two frequencies along the principal xz, yz planes and diagonal Φ=45°, 135° planes revealed a good agreement between the simulation and measurements, in terms of monostatic RCS scattering patterns and −10 dB RCS reduction bandwidths.

A number of embodiments have been described. Nevertheless, it will be understood that various modifications may be made without departing from the spirit and scope of disclosure. Accordingly, other embodiments are within the scope of the following claims.

What is claimed is:

1. An electromagnetic band gap checkerboard surface comprising:

a first quadrant and a third quadrant, the first and third quadrants each comprising a multiplicity of first dual-band electromagnetic band gap structures having a first resonant frequency and a second resonant frequency; and a second quadrant and a fourth quadrant, the second and fourth quadrants each comprising a multiplicity of second dual-band electromagnetic band gap structures having a third resonant frequency and a fourth resonant frequency;

wherein the first quadrant is directly adjacent to the second quadrant and the fourth quadrant, the third quadrant is directly adjacent to the second quadrant and the fourth quadrant, the first quadrant and the third quadrant are diagonally juxtaposed, and the second quadrant and the fourth quadrant are diagonally juxtaposed.

2. The electromagnetic band gap checkerboard surface of claim 1, wherein each first dual-band electromagnetic band gap structure comprises a square loop surrounding a square patch.

3. The electromagnetic band gap checkerboard surface of claim 2, wherein each first dual-band electromagnetic band gap structure is square and has dimensions in a range between 10 mm×10 mm and 20 mm×20 mm.

4. The electromagnetic band gap checkerboard surface of claim 2, wherein an outside length of a side of each square loop is in a range between 10 mm and 18 mm.

5. The electromagnetic band gap checkerboard surface of claim 2, wherein an inside length of a side of each square loop is in a range between 6 mm and 16 mm.

6. The electromagnetic band gap checkerboard surface of claim 2, wherein the square patch is square and has dimensions in a range between 4 mm and 12 mm.

7. The electromagnetic band gap checkerboard surface of claim 2, wherein the square patch is solid.

8. The electromagnetic band gap checkerboard surface of claim 1, wherein each second dual-band electromagnetic band gap structure comprises a circular loop surrounding a circular patch.

9. The electromagnetic band gap checkerboard surface of claim 8, wherein each second dual-band electromagnetic band gap structure is square and has dimensions in a range between 10 mm×10 mm and 20 mm×20 mm.

10. The electromagnetic band gap checkerboard surface of claim 8, wherein an outside diameter of each circular loop is in a range between 5 mm and 15 mm.

11. The electromagnetic band gap checkerboard surface of claim 8, wherein an inside diameter of each circular loop is in a range between 4 mm and 14 mm.

12. The electromagnetic band gap checkerboard surface of claim 8, wherein the circular patch is circular and has a diameter in a range between 2 mm and 12 mm.

13. The electromagnetic band gap checkerboard surface of claim 8, wherein the circular patch is solid.

14. The electromagnetic band gap checkerboard surface of claim 1, wherein the first quadrant and the third quadrant each comprises $n^2$ first dual-band electromagnetic band gap structure elements and the second quadrant and the fourth quadrant each comprises $n^2$ second dual-band electromagnetic band gap structure elements, where n is an integer greater than or equal to 2.

15. The electromagnetic band gap checkerboard surface of claim 1, wherein the first resonant frequency, the second resonant frequency, the third resonant frequency, and the fourth resonant frequency are all different frequencies.

16. The electromagnetic band gap checkerboard surface of claim 15, wherein the first resonant frequency is 3.4 GHz.

17. The electromagnetic band gap checkerboard surface of claim 15, wherein the second resonant frequency is 9.4 GHz.

18. The electromagnetic band gap checkerboard surface of claim 15, wherein the third resonant frequency is 5.9 GHz.

19. The electromagnetic band gap checkerboard surface of claim 15, wherein the fourth resonant frequency is 10.9 GHz.

20. The electromagnetic band gap checkerboard surface of claim 1, wherein fields reflected by the first dual-band electromagnetic band gap structures are out-of-phase from fields reflected by the second dual-band electromagnetic band gap structures at two or more frequencies.

21. The electromagnetic band gap checkerboard surface of claim 1, wherein the electromagnetic band gap checkerboard surface is square, and a length of each side exceeds 100 mm.

22. The electromagnetic band gap checkerboard surface of claim 1, wherein the electromagnetic band gap checkerboard surface demonstrates −10 dB dual radar cross section reduction bandwidths of over 24%.

* * * * *